US006308693B1

(12) United States Patent
Lee

(10) Patent No.: US 6,308,693 B1
(45) Date of Patent: Oct. 30, 2001

(54) SUPERCHARGER FOR AUTOMOBILE

(75) Inventor: Jong Sub Lee, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/473,794

(22) Filed: Dec. 28, 1999

(30) Foreign Application Priority Data

Aug. 25, 1999 (KR) ..... 99-035490

(51) Int. Cl.[7] ..... F02B 39/04
(52) U.S. Cl. ..... 123/559.1; 123/564
(58) Field of Search ..... 60/609; 123/559.1, 123/564

(56) References Cited

U.S. PATENT DOCUMENTS 2,745,392 * 5/1956 Nallinger ..... 123/559.1

* cited by examiner

*Primary Examiner*—Michael Koczo

(57) ABSTRACT

A super charger for an internal combustion engine comprises a camshaft having an extended end protruded out of a cylinder block of the engine, a turbine mounted on the extended end of the camshaft, an air compressing chamber mounted around the turbine, and two super charging lines connecting the air compressing chamber with an air cleaner and a throttle valve body respectively

4 Claims, 1 Drawing Sheet

SUPERCHARGER FOR AUTOMOBILE

FIELD OF THE INVENTION

The present invention relates to a supercharger for an internal combustion engine, more particularly a supercharger for an internal combustion engine of an automobile, that uses power taken from the camshaft of the engine and is simple in construction.

BACKGROUND OF THE INVENTION

Generally, an internal combustion engine for an automobile sucks the air needed for driving the engine by using the negative pressure generated when the engine is driven.

In order to increase the output of the engine, the amount of air provided to the engine should be increased. In order to make an automobile more powerful, a supercharger, which is like a turbocharger, is provided in the automobile. The supercharger increases the supply of air to the internal combustion engine of the automobile.

The supercharger supplies more air than the normal amount of air sucked by the engine using negative pressure. With the supercharger, the engine ignites more fuel with the increased amount of air, thus increasing the output of the engine.

The prior supercharger, like the turbocharger that is adopted in many kinds of automobiles, supplies air to the engine by using a turbine, that is operated by the exhaust gas of the engine.

However, the prior supercharger has many components and complicated construction. Therefore, the prior supercharger is expensive in its cost and heavy. The weight of the supercharge disadvantageously increases the weight of the automobile.

SUMMARY OF THE INVENTION

The object of the present invention is to provide a supercharger for an internal combustion engine of an automobile that is simple in its construction and is not heavy in its weight.

To achieve the above object, the present invention comprises a camshaft having an extended end protruded out of a cylinder block of the engine, a compressor mounted on the extended end of the camshaft, an air compressing chamber mounted around the compressor, a first supercharging line connecting the air compressing chamber to an air cleaner, and a second supercharging line connecting the air compressing chamber to a throttle valve body.

The supercharging line connected with the throttle valve body is connected to the portion of the throttle valve body where a valve for opening and closing the valve body is positioned.

The power taken from the camshaft drives the supercharger in accordance with the present invention. The construction of the supercharger can be simple and the number of parts used in the supercharger decreased.

Furthermore the weight of the supercharger can be reduced, because the number of parts used in the supercharger is decreased.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION

Figure 1:
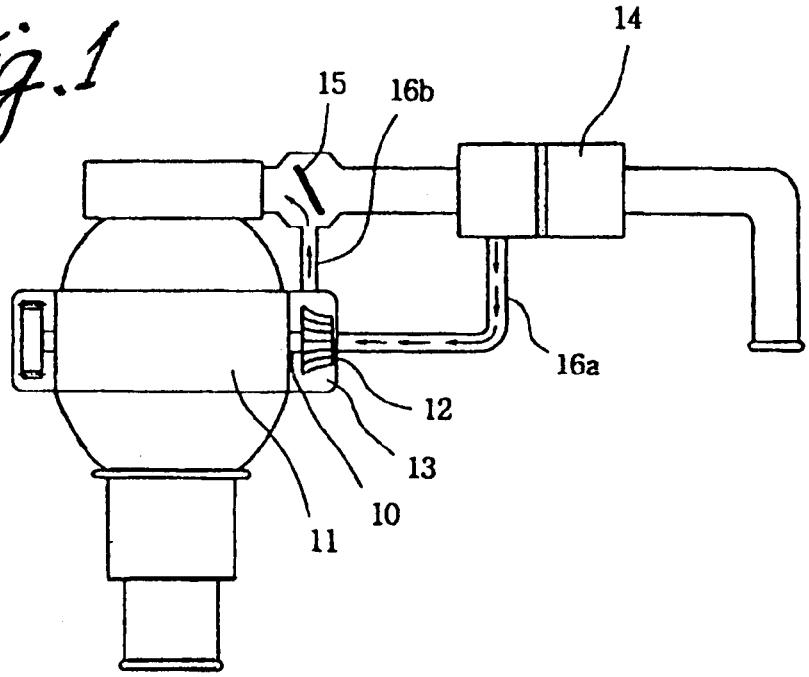
FIG. 1 is a schematic diagram of the supercharger in accordance with the present invention in a state where a throttle valve is opened.
Figure 2:
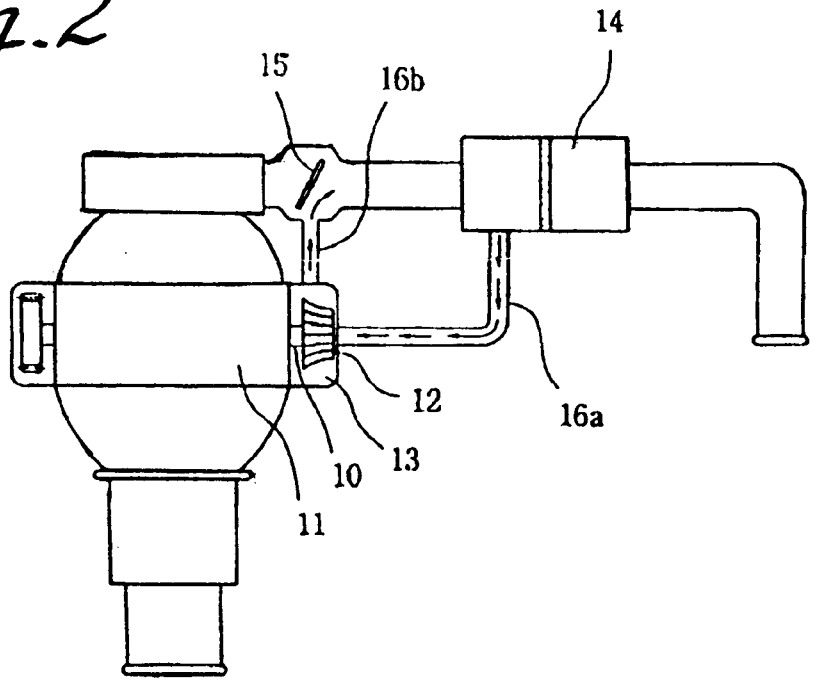
FIG. 2 is a schematic diagram of the supercharger in accordance with the present invention in a state where a throttle valve is closed.

FIGS. 1 and 2 are schematic diagrams of an internal combustion engine provided a supercharger in accordance with the present invention.

The supercharger in accordance with the present invention comprises a camshaft 10 having an extended end protruded out of a cylinder block 11 of the engine, a compressor 12 mounted on the extended end of the camshaft 10, an air compressing chamber 13 mounted around the compressor 12, a first supercharging line 16*a* connecting the air compressing chamber to an air cleaner 14 and a second supercharging line 16*b* connecting the air compressing chamber 13 with a throttle valve body 15.

The second supercharging line 16*b* is connected to the throttle valve body at the portion where a valve for opening or closing the valve body is positioned. Therefore, the air sucked from the air cleaner 14 is supplied to the engine or returned to the air cleaner 14 depending on whether the valve of the throttle valve body 15 is opened or closed.

One end of the camshaft 10 is extended out of the cylinder block 11, and the compressor 12 is mounted on the extended portion of the camshaft 10.

The compressor 12 is rotated with the camshaft 10 and sucks air from the air cleaner 14. The air sucked from the air cleaner 14 is compressed in the air-compressing chamber 13 and supplied to the throttle valve body 15. The air-compressing chamber 13 mounted around the compressor 12 is a kind of a housing, which can accumulate the compressed air in it.

The supercharging lines 16*a,* 16*b* connecting the air compressing chamber 13 with the throttle valve body 15 and the air cleaner 14 respectively are composed of a kind of air hose, and are separated from each other.

Furthermore, the second supercharging line 16*b* is connected with the throttle valve body 15 at the portion of the throttle valve body where the valve for opening or closing the valve body 15 is positioned. Therefore, according to the valve of the valve throttle body 15, the air supplied through the supercharging line 16*b* is either blown into a combustion chamber of the engine or returned to the air cleaner 14.

The internal combustion engine having the supercharger in accordance with the present invention is driven normally at normal speed and a predetermined amount of the air is supplied to the engine.

Then, in the course of speeding up suddenly, an actuator operates the supercharger in accordance with the present invention.

When the actuator operates the supercharger, the camshaft drives the compressor 12 in the air-compressing chamber 13. Then, air is sucked from the air cleaner 14 through the first supercharger line 16*a*. The air sucked is compressed in the air-compressing chamber 13. The compressed air is supplied to the throttle valve body 15 through the second supercharger line 16*b*.

When the valve of the throttle valve body 15 is opened, as shown in FIG. 1, the air from the air compressing chamber 13 is blown into the engine. On the contrary, when the valve is closed, as shown in FIG. 2, the air from the air compressing chamber 13 is returned to the air cleaner 14.

Therefore, when it is necessary to suddenly increase the driving speed of the engine, the compressed air is supplied into the combustion chamber of the engine. As the result of the supply of compressed air to the combustion chamber, the efficiency of firing the fuel and air mixture in the combustion chamber of the engine is highly increased in comparison with a normal state, and the output of the engine is increased.

As described above, because the power taken from the camshaft drives the supercharger in accordance with the present invention, the constructions of the supercharger may be simple and the number of parts used in the supercharger may be decreased.

Furthermore, the weight of the supercharger can be reduced, because the number of parts used in the supercharger is decreased.

What is claimed is:

1. A supercharger for an internal combustion engine having a cylinder block, the supercharger comprising:

a camshaft having an extended end protruded out of the cylinder block of the engine;

a compressor mounted on the extended end of the camshaft;

an air compressing chamber mounted around the compressor; and two supercharging lines connecting the air compressing chamber with an air cleaner and a throttle valve body respectively.

2. A supercharger for an internal combustion engine according to claim 1, wherein the supercharging line connected with the throttle valve body is connected to a portion of the throttle valve body where a valve for opening and closing the throttle body is set.

3. A supercharger for an internal combustion engine the supercharger comprising:

a camshaft;

a compressor mounted on the camshaft;

an air compressing chamber mounted around the compressor; and a first supercharging line connecting the air compressing chamber with an air cleaner; and a second supercharging line connecting the air compressing chamber with a throttle valve body.

4. A supercharger for an internal combustion engine according to claim 3, wherein the throttle valve body comprises a valve for controlling flow through the throttle valve body.

* * * * *